US006848452B2

(12) United States Patent
Kennedy et al.

(10) Patent No.: US 6,848,452 B2
(45) Date of Patent: Feb. 1, 2005

(54) HAIR COLORING DEVICE AND METHODS

(75) Inventors: Melvin R. Kennedy, Lantana, FL (US); Jose Longoria, Miami, FL (US); Robert G. Robbins, Boca Raton, FL (US)

(73) Assignees: Kennedy/Matsumoto Design LLC, Lantana, FL (US); Longoria Design LLC, Miami, FL (US); Spectrum Associates LLC, Boca Raton, FL (US)

( * ) Notice: Subject to any disclaimer, the term of this patent is extended or adjusted under 35 U.S.C. 154(b) by 0 days.

(21) Appl. No.: 10/370,262

(22) Filed: Feb. 19, 2003

(65) Prior Publication Data

US 2004/0159329 A1 Aug. 19, 2004

(51) Int. Cl.[7] ..... A61K 7/13
(52) U.S. Cl. ..... 132/208; 132/119.1; 132/270
(58) Field of Search ..... 401/9, 10, 268; 132/108, 110, 119, 120, 208, 119.1, 270

(56) References Cited

U.S. PATENT DOCUMENTS

| | | | | |
|---|---|---|---|---|
| 3,195,537 A | | 7/1965 | Blasi | |
| 3,864,780 A | | 2/1975 | Watkins | |
| 4,211,247 A | * | 7/1980 | Morganroth | 132/270 |
| 4,602,651 A | * | 7/1986 | Roppatte, Jr. | 132/320 |
| 4,958,647 A | | 9/1990 | Busch et al. | |
| 3,491,774 A | | 3/1994 | Carbone | |
| 5,622,192 A | | 4/1997 | Chiou | |
| 5,647,841 A | | 7/1997 | Groenewold et al. | |
| 5,784,744 A | | 7/1998 | Toran | |
| 5,937,865 A | | 8/1999 | Dhaliwal | |
| 5,972,043 A | | 10/1999 | Galvan et al. | |
| 6,012,462 A | | 1/2000 | Schmittou | |
| 6,022,163 A | | 2/2000 | Asfur | |
| 6,050,271 A | | 4/2000 | Spencer | |
| 6,053,177 A | | 4/2000 | Sofer | |
| 6,062,230 A | | 5/2000 | Kajgana | |
| 6,145,513 A | | 11/2000 | Chu et al. | |
| 6,170,108 B1 | | 1/2001 | Knight | |
| 6,357,449 B1 | | 3/2002 | Chu et al. | |
| 6,460,546 B1 | | 10/2002 | Sofer | |
| 6,513,534 B1 | | 2/2003 | Sofer et al. | |
| 6,626,599 B2 | | 9/2003 | De Laforcade | |
| 6,746,165 B2 | | 6/2004 | De Laforcade | |
| 2002/0148484 A1 | | 10/2002 | Chu et al. | |

FOREIGN PATENT DOCUMENTS

| | | |
|---|---|---|
| GB | 808762 | 2/1959 |
| GB | 819778 | 9/1959 |
| JP | 1244708 | 9/1989 |
| JP | 2002-345543 | 12/2002 |
| YU | 2320094 | 5/1999 |

* cited by examiner

*Primary Examiner*—Kevin Shaver
*Assistant Examiner*—Stephanie L. Willatt
(74) *Attorney, Agent, or Firm*—Akerman Senterfitt

(57) ABSTRACT

A hair coloring applicator for applying a hair coloring material to one or more strands of hair using a rotating brush. The hair coloring applicator may include one or more brushes rotatably coupled to a body. The body may include a housing having at least one opening for receiving one or more strands of hair. The brush may include a plurality of bristles configured to contact the one or more strands of hair without tangling or snagging the hair. The bristles of the brush receive a hair coloring material and apply the material to strands of hair by contacting the hair. The hair coloring applicator may simultaneously apply one or more colors of hair coloring material to strands of hair.

45 Claims, 8 Drawing Sheets

HAIR COLORING DEVICE AND METHODS

FIELD OF THE INVENTION

This invention is directed generally to hair coloring, and more particularly to systems and methods for applying hair coloring materials to hair.

BACKGROUND

In modern society, it is not uncommon for people to color their hair. However, not all hair coloring is alike, nor is all hair colored for the same reasons. For instance, middle aged people and senior citizens often chose to color their hair so that they appear younger. Women, and some men, sometimes choose to place highlights in their hair. Still yet, other individuals, who typically are young, often choose bright colors to color their hair for many reasons. The hair coloring procedures used to generate these results are often markedly different and use different coloring materials. The hair coloring materials may be dyes that may or may not be easily washed from the colored hair with conventional shampoo and water, or other materials.

For as many reasons exist for a person to color their hair, there exist nearly as many systems for applying color to hair. For instance, hair may be colored by hair professionals in salons using liquid dyes. The dyes are often thoroughly mixed with the hair by the hands of a technician or stylist. This process may also be completed at home using dyes purchased at retail stores. Another system for applying color to hair is shown in U.S. Pat. No. 6,053,177, which depicts a cartridge coupled to a plurality of hollow dispensing tines. The tines resemble the bristles of a common hair brush. The cartridge includes a piston that forces a hair dye through the tines to contact hair while the cartridge is passed through hair as though brushing hair using a conventional hair brush. While these systems provide methods for applying dye to hair, most of these systems do not facilitate easy to use methods of applying dye to select portions of hair on a person's head. In addition, most conventional systems involve undesirable contact of a person's hands with hair dyes.

Thus, a need exists for a hair color applicator capable of overcoming these and other disadvantages of the conventional systems.

SUMMARY OF THE INVENTION

This invention relates to a hair coloring applicator for applying a hair coloring material to one or more strands of hair. The hair coloring material may be formed from one or more colors and from a variety of materials, such as, but not limited to pastels, hair mascara, and others. The hair coloring applicator may include one or more brushes having a plurality of bristles. In at least one embodiment, the bristles may be angled away from the direction of rotation of the brush. The brush may be rotatably coupled to a body and configured to contact strands of hair without tangling the hair. The body of the hair coloring applicator may include a housing configured to contain at least a portion of the brush. The housing may include one or more openings configured to receive one or more strands of hair and place the strands of hair in contact with the bristles of the brush. The hair coloring applicator may also include at least one device for applying a hair coloring material to the plurality of bristles of the brush.

In one embodiment, the device for applying a hair coloring material to the bristles may be a cavity in the housing. The cavity may be configured to contain a cartridge holding a hair coloring material in a position so that the hair coloring material may contact the bristles of the brush. The cartridge may hold one or more colors of hair coloring material. The cavity may also include a biasing mechanism for biasing the cartridge towards the bristles of the brush. In another embodiment, the device may be formed from one or more orifices in the housing for receiving a hair coloring material. In at least one embodiment, the orifice may contain a retention mechanism, such as threads, for engaging a container holding a hair coloring material.

The hair applicator may also include a deflector for positioning one or more strands of hair in the opening in the housing. The deflector may form a hair channel between the deflector and the opening in the housing through which strands of hair may pass. The deflector may include a flat, curved, or other shaped inside surface corresponding to a configuration of the bristles of the brush. The deflector may be moved between open and closed positions. In at least one embodiment, the deflector may be biased towards the closed position, which applies a predetermined amount of pressure to the deflector. The brush of the hair coloring applicator may be rotated using a drive device. The drive device may be a crank, a motor, or other device for rotating the brush. In embodiments having the motor, the motor may be coupled to the brush using one or more gears. A power supply may be coupled to the motor. The power source may be one or more batteries, a publicly available power system, or other such device. A switch may be include in the body for controlling the motor.

The body of the hair coloring applicator may include a handle for facilitating use of the hair coloring applicator. The handle may be ergonomically designed to reduce fatigue of a user. In at least one embodiment, the handle may house the power source and motor. The handle may be removable to facilitate removal of excess hair coloring material from the housing and brush without jeopardizing the motor and power source contained in the handle to contact with water. In some embodiments, the brush may be removable for cleaning or replacement, or both.

The hair coloring applicator may be used for a variety of purposes. For instance, and not by way of limitation, the hair coloring applicator may be used to add bright colors to hair, which is often desirable for clowns, young girls, sports fans, and others. The hair coloring applicator may also be used to color a natural streak of hair on a person that is not the same color as the rest of the hair. For example, the hair coloring applicator may be used to add color a streak of gray hair so that the gray streak blends in with the surrounding hair. In another example, the hair coloring applicator may be used to apply a highlight, such as a blonde streak, to a head of hair. In yet another example, the hair coloring applicator may be used to add streaks of multiple colors to a head of hair. These and other uses will become apparent upon review of the enclosed drawings and detailed description below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

This invention is directed to a hair coloring applicator 10, as shown in FIGS. 1–18. Hair coloring applicator 10 may have numerous configurations capable of applying a hair coloring material 44 to one or more strands of hair. The strands of hair may be human hair found growing from or connected to a human head, strands of hair connected to a wig, hair connected to a device for holding hair, or other hair. Hair coloring device is not limited to coloring only human hair, but may be used to color dolls, animal hair, filaments, and other items.

Figure 3:
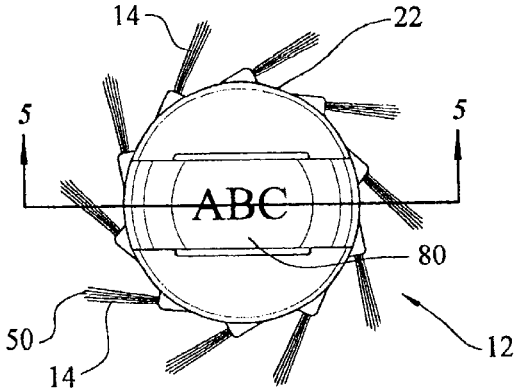
FIG. 3 is a front view of a brush of the hair coloring applicator.
Figure 4:
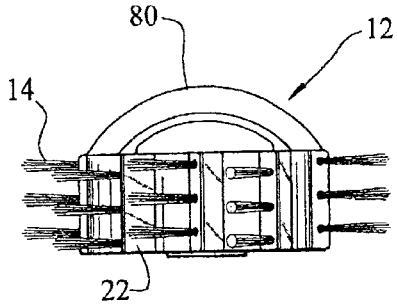
FIG. 4 is a top view of the brush of FIG. 3.
Figure 5:
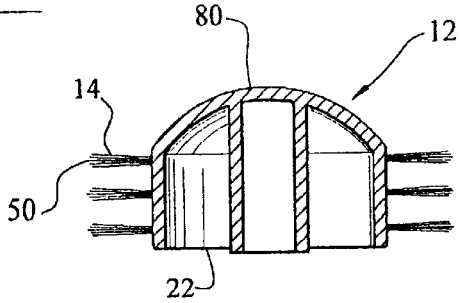
FIG. 5 is a cross-sectional view of the brush of FIG. 3 taken at line 5—5.

Hair coloring applicator 10 may be formed from one or more brushes 12 having a plurality of bristles 14, as shown in FIGS. 3–5. Brush 12 may be rotatably mounted to a body 16 using shaft 18. Bristles 14 may extend from brush 12 and be angled away from the direction of rotation 20 of brush 12. In at least one embodiment, bristles 14 may be positioned at an angle between about 30 degrees and about 60 degrees relative to lines that are generally tangent to a generally circular hub 22 forming brush 12 at points where the bristles connect to the hub. Bristles 14 may be formed from any acceptable material, such as, but not limited to, synthetic materials, such as plastics and other materials.

Figure 1:
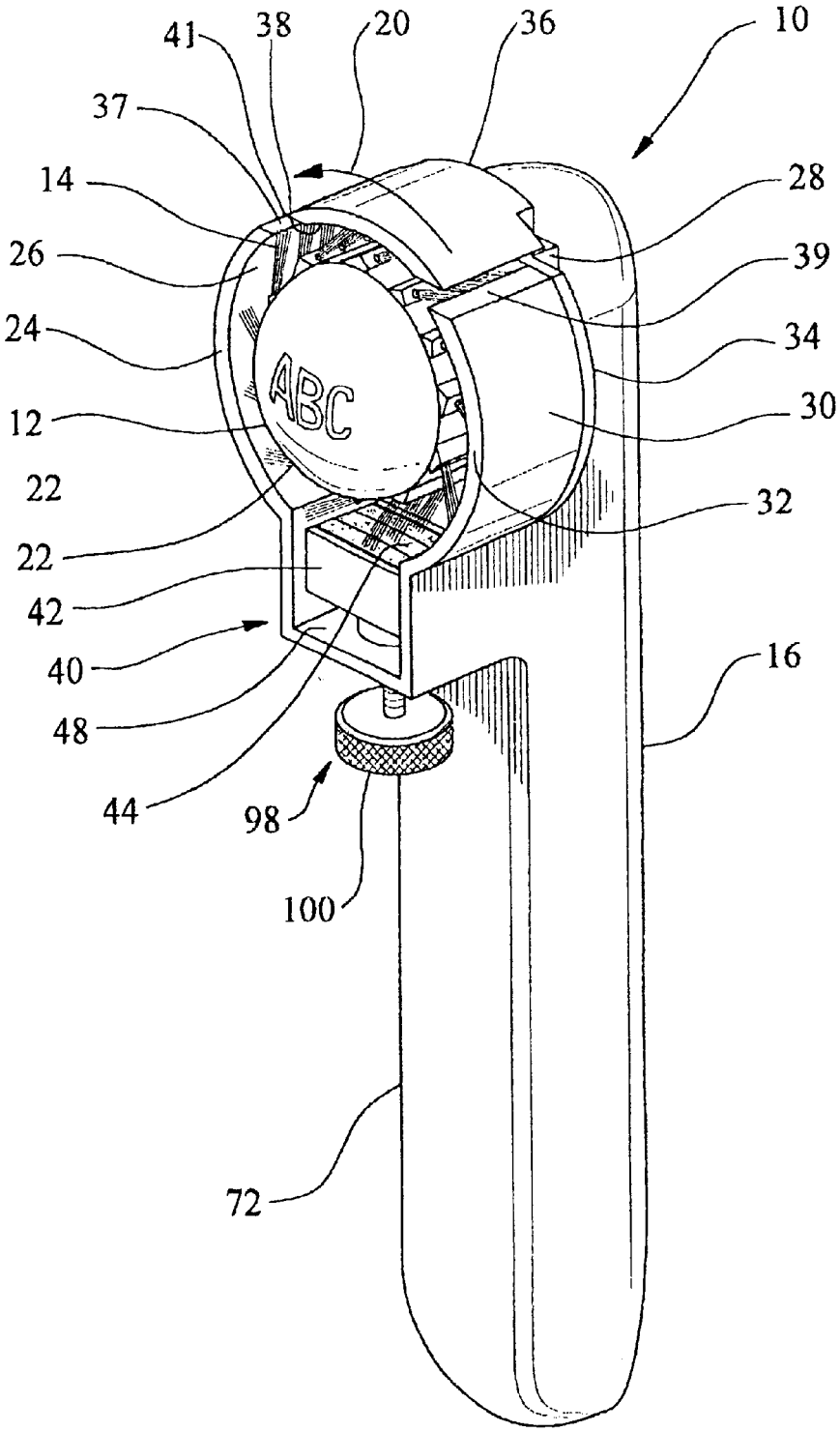
FIG. 1 is a perspective view of a hair coloring applicator.
Figure 2:
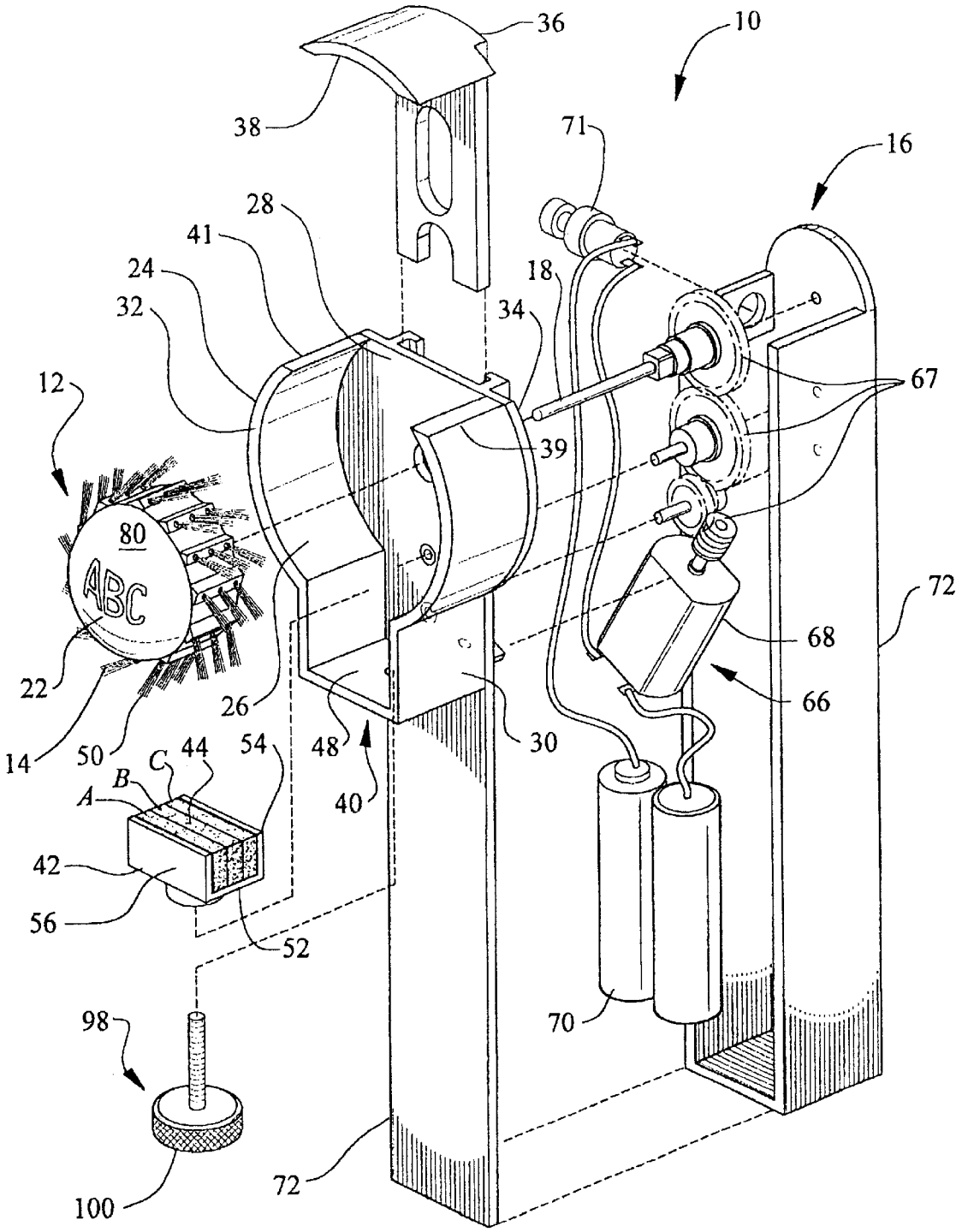
FIG. 2 is an exploded view of the hair coloring applicator of FIG. 1.

In at least one embodiment, bristles 14 are configured to be contained in a housing 24. Bristles 14 extend from hub 22 of brush 12 toward an inside surface 26 of housing 24. Housing 24 may contain at least a portion of brush 12. In one embodiment, housing 24 is substantially circular, as shown in FIGS. 1 and 2. Housing 24 may cover a substantial portion of brush 12. The thickness of housing 24 is preferably at least slightly wider than a thickness of hub 22 of brush 12, to avoid unnecessary wear to housing 24 and brush 12. However, hair coloring applicator 10 is not limited to this arrangement. Housing 24 may substantially prevent inadvertent contact with bristles 14 while brush 12 is rotating and thereby prevent hair coloring material 44 from contacting a user's arm, clothing, furniture, or other objects.

Housing 24 may also include at least one opening 28 for receiving at least one strand of hair. Opening 28 may be formed on an outside surface 30 of housing 24. Opening 28 may extend from a front surface 32 of housing 24 partially towards a back surface 34 of housing 24, or may contact the bottom surface. In another embodiment, opening 28 may extend from front surface 32 to back surface 34. Opening 28 may have any configuration capable of receiving one or more strands of hair. Opening 28 may be generally circular, rectangular, as shown in FIG. 2, or any other shape.

Opening 28 may be covered with a deflector 36. Deflector 36 may, in effect, define a hair channel 37. Hair channel 37 may have an inlet 39 and an outlet 41, whereby one or more strands of hair may be feed into hair coloring applicator device 10, contact bristles 14, and exit through the outlet. Deflector 36 may be movably coupled to housing 24. In one embodiment, deflector 36 is slidably coupled to housing 24 and is capable of moving from a closed position, where the deflector may contact bristles 14 to an open position, where the deflector may be removed, or substantially removed, from contact with the bristles. In this configuration, deflector 36 may be biased towards the closed position in which the deflector is in contact with bristles 14. Alternatively, deflector 36 may be biased towards the open position and away from being in contact with bristles 14. In another embodiment, deflector 36 may be rotatably coupled to housing 24 so that the deflector may be rotated between a closed position, and an open position. In at least one embodiment, deflector 36 may have a generally flat inside surface 38. In yet another embodiment, inside surface 38 maybe curved to correspond with the radius of curvature of bristles 14 of brush 12 or be curved away from the bristles.

Hair coloring applicator 10 may also include a device 40 for applying hair coloring material to bristles 14 of brush 12. Device 40 may be any device capable of placing a hair coloring material 44 in contact with bristles 14 of brush 12. In at least one embodiment, device 40 includes a cavity formed in housing 24 for containing a cartridge 42. Cartridge 42 may or may not be disposable. Cartridge 42 may be configured in numerous manners. In one embodiment, cartridge 42 may be formed from a base 52, and side walls 54 and 56.

Cartridge 42 may contain hair coloring material 44 having one or more colors, which may include, but are not limited to, red, yellow, pink, orange, green, blue, purple, brown, black, any combinations or shades thereof, or others. Hair coloring material 44 having different colors may be separated into distinct sections in cartridge 42, which may enable the creation of color strips in strands of hair. Alternatively, hair coloring material 44 may be swirled or otherwise mixed together.

Figure 22:
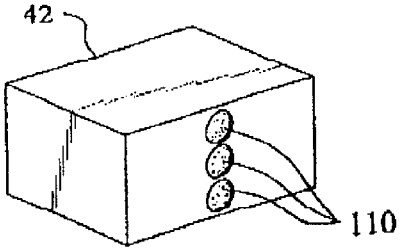
FIG. 22 is an alternative embodiment of a cartridge for containing a hair coloring material.
Figure 23:
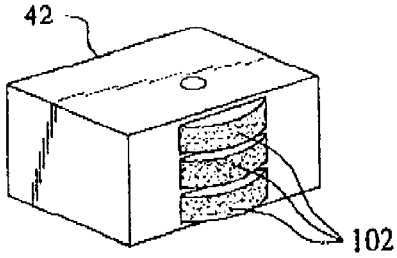
FIG. 23 is another alternative embodiment of a cartridge for containing a hair coloring material.
Figure 24:
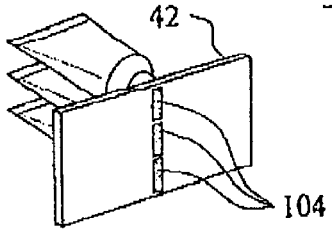
FIG. 24 is yet another alternative embodiment of a cartridge for containing a hair coloring material.

Cartridge 42 may be configured to contain solid or liquid hair coloring materials 44, or both. For instance, a shown in FIG. 2, cartridge 42 may be configured to receive individual sticks of pastels. The pastels may be installed in cartridge 42 by an end user or during a manufacturing process. Cartridge 42 may also be configured, as shown in FIG. 22, to include a plurality of openings 110. Each opening 110 may be connected to a cavity for containing a liquid hair coloring material 44. In another embodiment, as shown in FIG. 23, cartridge 42 may include one or more rollers 102 for dispensing one or more hair coloring materials. Each roller 102 may or may not be coupled to a separate cavity. In yet another embodiment, as shown in FIG. 24, cartridge 42 may include one or more containers 104, which may or may not be squeezable.

Hair coloring material 44 may be any material that is colored. Hair coloring material 44 may include, but is not limited to, pastels, powder, paint, hair coloring paste, hair mascara, liquids, chalk, glitter, or other appropriate material. The pastels may be used in varying degrees of hardness, such as, but not limited to, regular, soft and very soft, and in at least one embodiment, soft pastels are preferred. Hair coloring material 44 may be a permanent dye or may be nonpermanent and temporary in duration. In at least one embodiment, hair coloring material 44 may also be easily washed out of hair. Hair coloring material 44 may include various scents.

Figure 17:
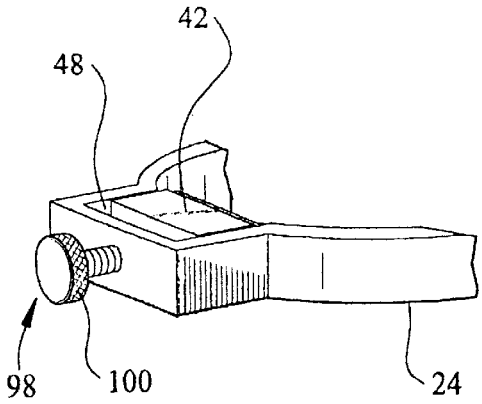
FIG. 17 is a partial perspective view of a device for applying a biasing mechanism in a cavity in a housing of the hair coloring applicator for placing a hair coloring material contained in a cartridge in contact with a brush.
Figure 18:
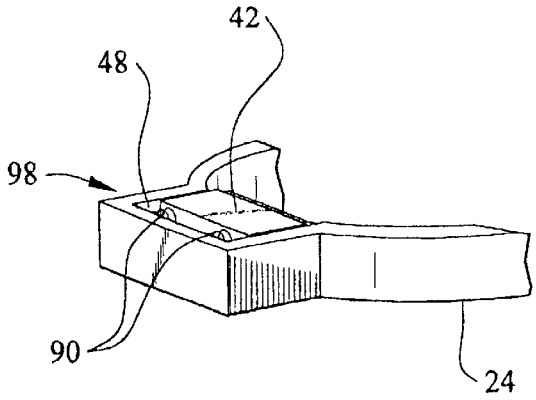
FIG. 18 is another embodiment of the biasing mechanism of FIG. 17.
Figure 19:
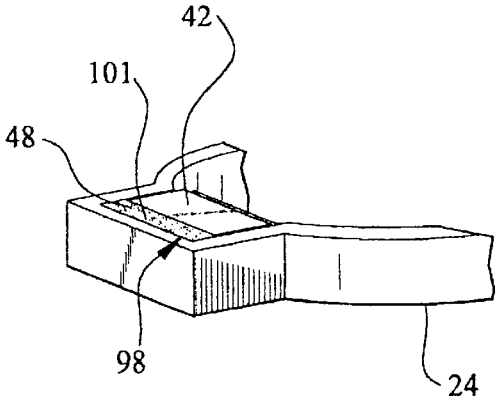
FIG. 19 is yet another embodiment of the biasing mechanism of FIG. 17.
Figure 20:
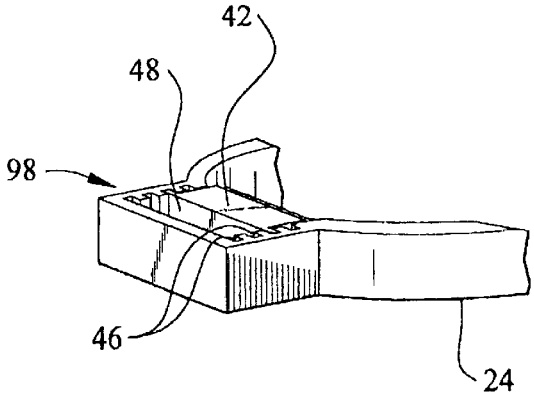
FIG. 20 is another embodiment of the biasing mechanism of FIG. 17.

Cartridge 42 may be held in position in cavity 48 with any appropriate biasing mechanism 98. For instance, as shown in FIGS. 1 and 2, cartridge 42 may be sized to fit tightly with the interior walls of cavity 48 or may be sized slightly smaller than the distance between the interior walls of cavity 48. In this configuration, cartridge 42 may fit in cavity 48 and may have little space to move out of position. Cartridge 42 may be advanced towards bristles 14 of brush 12 using any number of appropriate materials. For instance, and not by way of limitation, cartridge 42 may be biased towards brush 12 using biasing mechanism 98, which may be, but is not limited to, one or more springs 90, as shown in FIG. 18, a threaded rod 100, as shown in FIGS. 1, 2, and 17, a compressible material 101, such as foam, as shown in FIG. 19, guides 46, as shown in FIG. 20, or other appropriate device.

Figure 13:
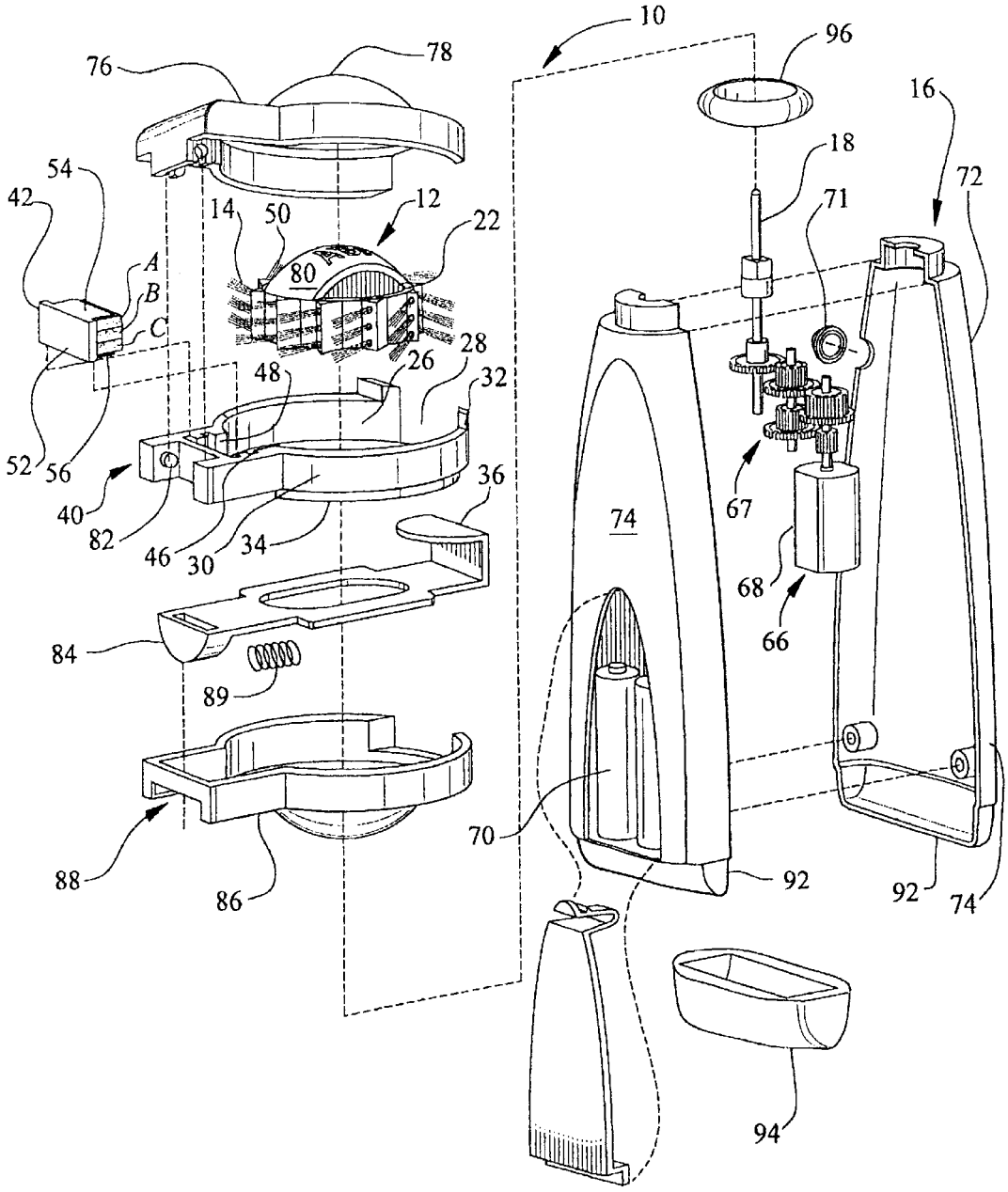
FIG. 13 is an exploded perspective view of another embodiment of the hair coloring applicator.

In another embodiment, cartridge 42 may be held in position using one or more guides 46 in cavity 48, as shown in FIG. 13. Guides 46 enable cartridge 42 to be placed in a position relative to tips 50 of bristles 14 so that the tips contact a top surface of the hair coloring material 44 contained in cartridge 42. As bristles 14 wear hair coloring material 44 away from cartridge 42, the cartridge may be repositioned in cavity 48 by inserting the cartridge into guides 46 closer to brush 12 so that tips 50 of the bristles once again contact hair coloring material 44 in cartridge 42.

Figure 6:
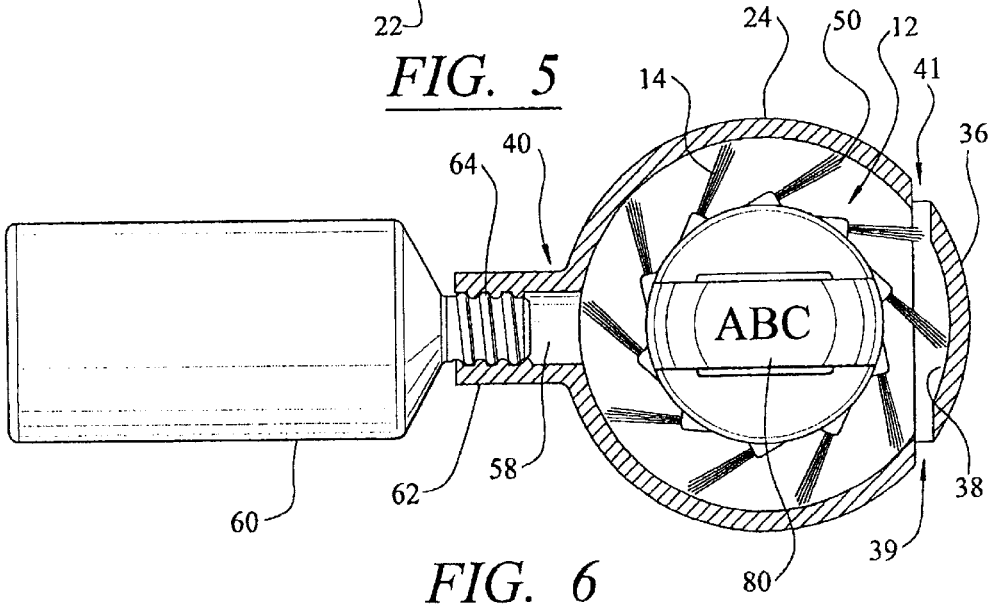
FIG. 6 is perspective view of another embodiment of the hair coloring applicator.

Device 40 may also be at least one orifice 58 for enabling hair coloring material 44 to contact tips 50 of bristles 14. Orifice 58 may be positioned in any location in housing 24. In one embodiment, as shown in FIG. 6, orifice 58 may be positioned in a side wall of housing 24. Orifice 58 may be sized and configured to allow hair coloring material 44 to pass through the orifice and contact bristles 14. In one embodiment, orifice 58 may be configured to receive one or more containers 60. Containers 60 may be disposable bottles. Container 60 may also be squeezable, manually or through use of a motorized system, to enable the hair coloring material contained in the container to be expelled. Container 60 may include a plunger for expelling a hair coloring material 44 contained in the container from the container. Container 60 may also be configured to contain two or more hair coloring materials 44 have different colors. Container 60 may include separate compartments for storing the different hair coloring materials. A flange 62 may be coupled to housing 24 proximate to orifice 58 to assist in supporting container 60. In one embodiment, flange 62 may include an attachment mechanism 64 which may be, but is not limited to, threads, ribs, clamps, interference fittings, or other attachment devices.

Hair coloring applicator 10 may also include a drive device 66 coupled to brush 12 for rotating the brush. Drive device 66 may be a crank assembly operable by a user turning the crank. In at least one other embodiment, drive device 66 may be a motor 68. Motor 68 may be an electric motor or other appropriate motor. Motor 68 may be coupled to shaft 18 through one or more gears 67. Gear 67 may be used to increase or decrease the rotational speed of brush 12 relative to motor 68. Gear 67 may positioned in any position, such as generally vertical or generally horizontal. Motor 68 may be in communication with a power supply 70. Power supply 70 may be a battery, as shown in FIGS. 2 and 13, or any device coupled to a conventional power supply system, such as a wall outlet. If power supply 70 is a battery, the battery may or may not be rechargeable. Power supply 70 or drive device 66 may be contained in a handle 72 or coupled to hair coloring applicator in another manner. Motor 68 may be controlled using a switch 71. Switch 71 may be any acceptable switch for turning motor 68 on and off.

Handle 72 may form a portion of body 16. Handle 72 may or may not have an ergonomically configured outside surface 74. Outside surface 74 may or may not be textured, such as, but not limited to, a knurled surface. Handle 72 may include a removable lid providing access to the one or more batteries in embodiments of hair coloring applicator using batteries. Handle 72 may be formed from one or more colors.

Figure 7:
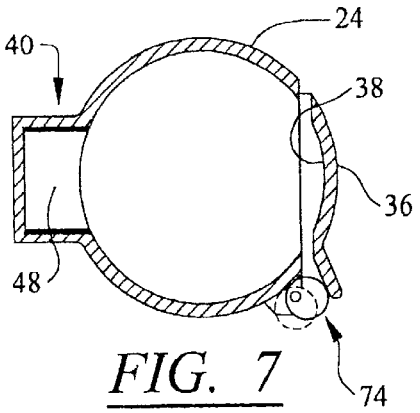
FIG. 7 is a top view of a braking mechanism usable with the hair coloring applicator.
Figure 8:
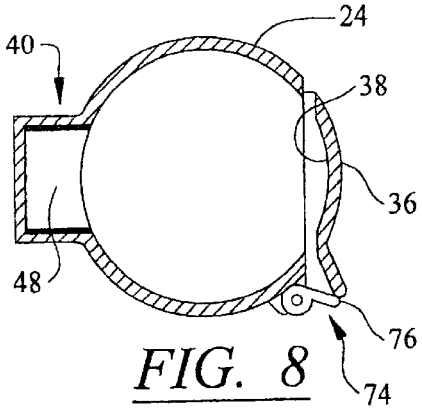
FIG. 8 is another embodiment of the braking mechanism of FIG. 7.
Figure 9:
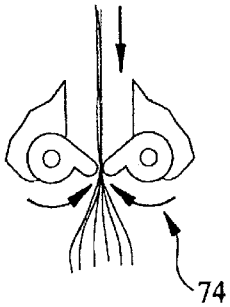
FIG. 9 is another embodiment of the braking mechanism of FIG. 7.
Figure 10:
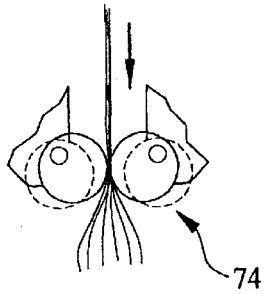
FIG. 10 is another embodiment of the braking mechanism of FIG. 7.

Hair coloring applicator 10 may also include a braking mechanism 75, as shown in FIGS. 7–10, for substantially preventing one or more strands of hair from passing in a backwards direction through hair channel 37 and possibly jamming hair coloring applicator 10. In at least one embodiment, braking mechanism 75 may be formed from one or more levers 76, as shown in FIG. 8. Lever 76 may be coupled to housing 24 proximate to outlet 41. This configuration allow hair to pass out of outlet 41, but prevents hair from traveling into the outlet, thereby preventing backwards flow. In another embodiment, braking mechanism 75 may be formed from an off-centered wheel, as shown in FIG. 7. The off-centered wheel operates much like lever 76 by preventing strands of hair from passing in a backwards direction through hair channel 37. In another embodiment, braking mechanism 75 may be formed from two juxtaposed levers having a channel passing between the levers, as shown in FIG. 9. In yet another embodiment, braking mechanism 75 may be formed from two wheels having a channel passing between the levers, as shown in FIG. 10. In yet another embodiment, braking mechanism 75 may be formed from ratcheted wheels. Braking mechanism 75 is not limited to these embodiments, but may include other mechanisms as well.

Figure 14:
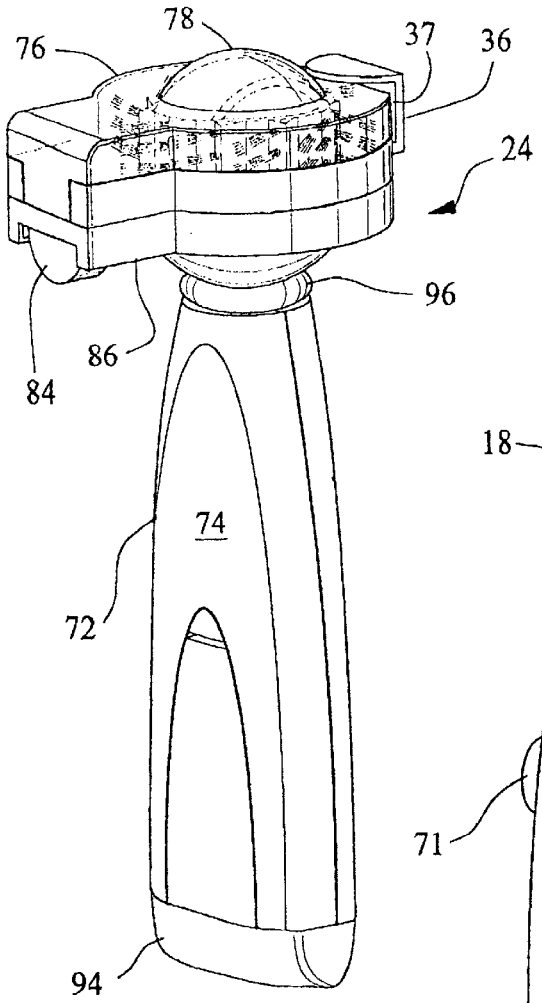
FIG. 14 is an assembled perspective view of the hair coloring applicator of FIG. 13.
Figure 15:
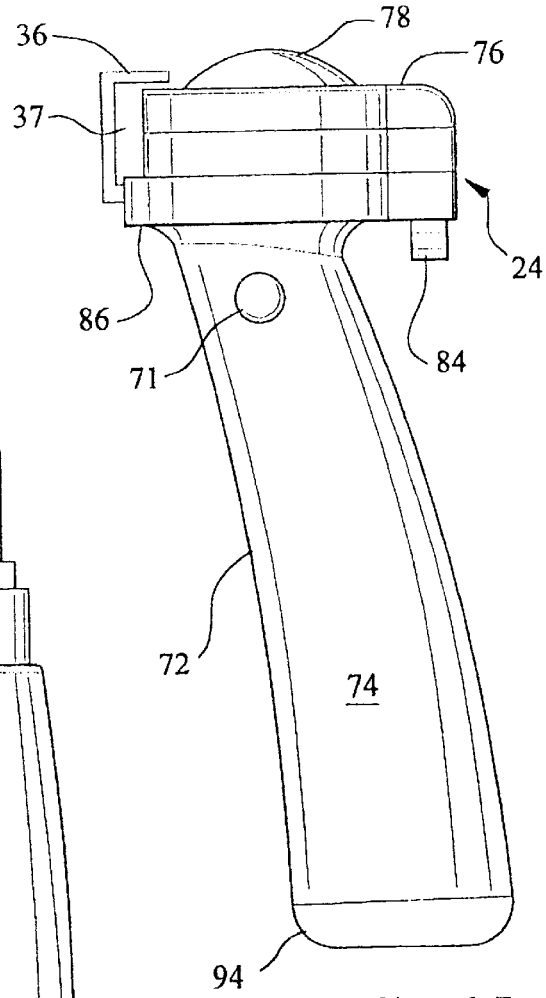
FIG. 15 is a side view of yet another embodiment of the hair coloring applicator.
Figure 16:
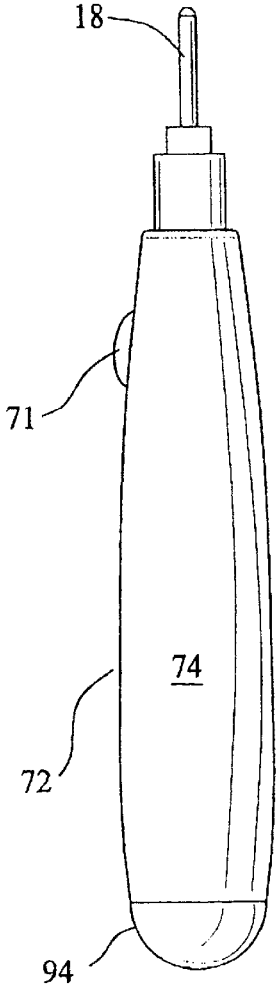
FIG. 16 is a partial front view of the embodiment shown in FIG. 15.

Hair coloring applicator 10 may be formed from another embodiment, as shown in an assembled view in FIGS. 14–16 and in an exploded view in FIG. 13. In this embodiment, hair coloring applicator 10 may include many of the features previously described. Elements that differ from those elements described above are discussed in more detail below. For instance, housing 24 may be configured to fit around a bottom portion of brush 12. Housing 24 may also include guides 46 for positioning one or more cartridges 42 in one or more positions. A cover 76 may be coupled to housing 24. Cover 76 may be pivotably coupled to housing 24 at posts 82. In one embodiment, cover 76 may include at least one viewing window 78 enabling a top surface 80 of brush 12 to be viewed through the cover. Viewing window 78 of cover 76 may be an orifice or may be formed from a relatively clear material. Top surface 80 of brush 12 may include graphical depictions, text messages, combinations thereof, or other visual objects. Top surface 80 may include advertisements, instructions, or warnings, in one or more languages.

Deflector 36 may be configured as describe above, but may also include retention mechanism 84. Deflector 36 may be configured to fit together with lower housing 86. Retention mechanism 84 may be sized and configured to fit in orifice 88. Orifice 88 may limit the distance of travel of retention mechanism 84 and thus deflector 36. Deflector 36 may be biased to a closed position using, for instance, a spring 89.

Handle 72 may be formed from one or more pieces, as shown in FIG. 13. For instance, handle 72 may be formed from at least three pieces; two halves 92 and a bottom member 94. Halves 92 and bottom member 94 may be assembled using screws, snap fittings, adhesives, or other mechanical connectors or chemical bonds or both. Handle 72 may have a curved configuration, as shown in FIG. 15. Body 16 may also include a ring 96 for retaining halves 92 together.

Figure 21:
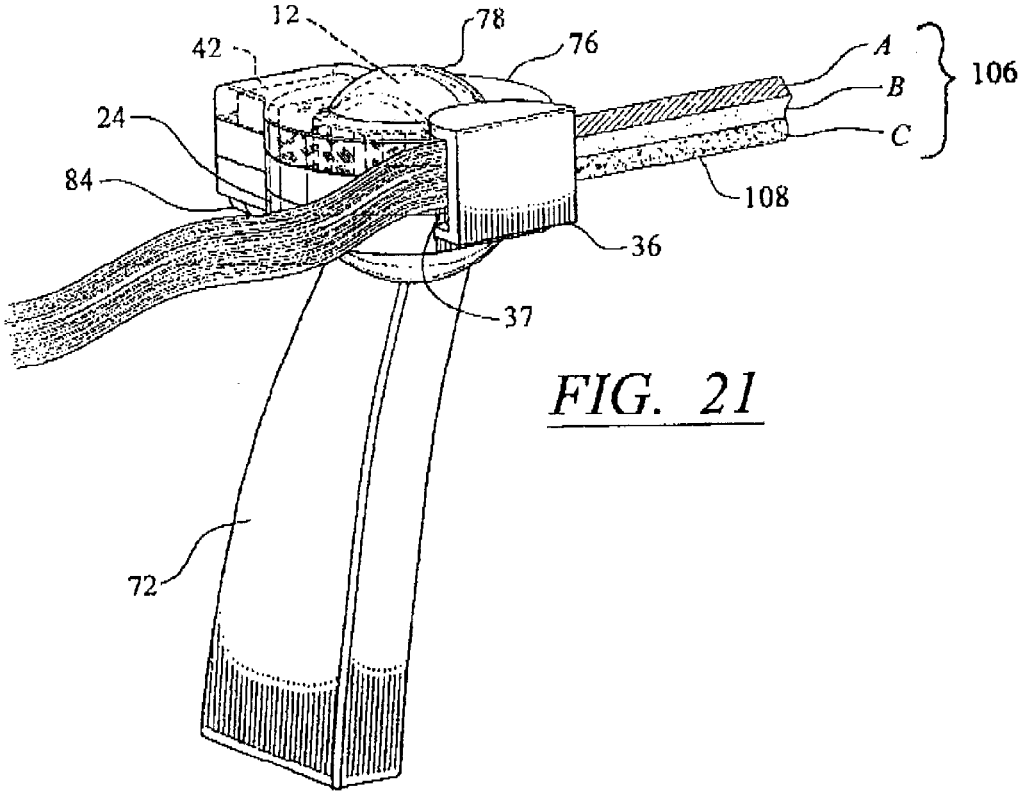
FIG. 21 is a perspective view of an embodiment of this invention with a collection of hair being colored with stripes.

Hair coloring applicator 10 may be used to apply one or more hair coloring materials 44 having one or more colors to strands of hair. In one embodiment, as shown in FIG. 21, hair coloring applicator 10 may be used to form stripes 106 of color hair 108 formed from colors A, B, and C. Hair coloring material 44 should be placed in a position to contact bristles 14 of brush 12. One or more strands of hair may be separated from other strands of hair. In one or more embodiments, a liquid may be applied to the collection of hair. The liquid may be water, hair spray, alcohol, any combination thereof, or other liquids capable of facilitating the transfer of hair coloring material 44 from bristles 14 to strands of hair. The liquid may be used to dissolve hair coloring material 44 when, for instance, the hair coloring material is in solid form, such as a powder.

Use of the liquid facilitates transfer of a hair coloring material 44 to strands of hair and may increase the aesthetic qualities of the strands of hair to which the hair coloring material has been applied. For instance, in one or more embodiments where hair coloring material 44 is a powder, the liquid may prevent strands of hair to which the hair coloring material has been applied from appearing chalky. The liquid may also include an adhesive, which may be a fixative, for adhering particles of hair coloring material 44 to strands of hair. The adhesive may be of varying strength. In at least one embodiment, the adhesive may keep the fixative adhered to strands of hair until the hair is washed.

One or more strands of hair may be placed in opening 28 of housing 24 so that the strands of hair feed into the opening, contact one or more bristles 14 of brush 12, and exit the opening. In embodiments having hair channel 37, one or more strands of hair may be placed in hair channel 37. While one or more strands or hair may be used in at least one embodiment, hair coloring applicator 10 may apply color to a collection of strands of hair that is about one inch wide by about 1/32 of an inch in thickness. The capacity of hair coloring applicator may vary and is not limited to this size collection of hair.

Figure 12:
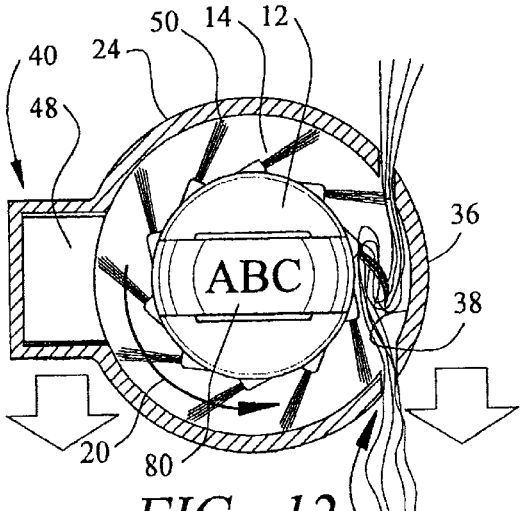
FIG. 12 depicts a possible results if hair is feed in a backwards direction into the hair coloring applicator.

Strands of hair may be placed into hair coloring applicator 10 while the applicator is proximate to a head, wig or other fixture holding the strands of hair to color substantially an entire length of the strands of hair. Alternatively, hair coloring applicator 10 may be positioned anywhere along the length of the strands of hair. To prevent the strands of hair from becoming entangled in brush 12, as shown in FIG. 12, the strands of hair can be held taut by pulling on the end of the strands of hair not coupled to a head, wig, or another stationary device. In addition, a force may be applied to deflector 36 to press against the strands of hair and against bristles 14 to enhance the transportation of hair coloring material from the bristles to the hair and to prevent the strands of hair from moving outside of hair channel 37, thereby reducing the likelihood that strands of hair will become entangled in brush 12. In one embodiment, this force is applied by a spring or other biasing mechanism.

Figure 11:
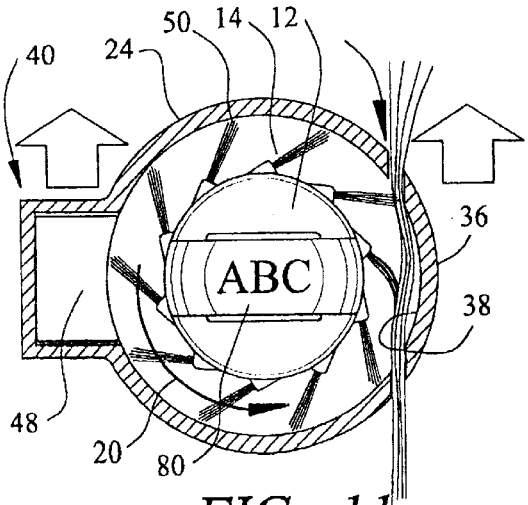
FIG. 11 depicts hair being feed into the hair coloring applicator.

Hair coloring applicator 10 may begin transferring hair coloring material from bristles 14 to strands of hair by rotating brush 12 while the strands of hair are in contact with the bristles. Brush 12 may be rotated using drive device 66, which may be motor 68, a crank, or other device. While using one or more embodiments containing motor 68, switch 71 may be actuated to control motor 68. Hair coloring applicator 10 should be pulled in a direction that is generally away from a head, wig, or other device holding hair to prevent strands of hair from becoming tangled in the hair coloring applicator. In addition, hair should be feed through inlet 39, as shown in FIG. 11, not through outlet 41, as shown in FIG. 12.

Brush 12 may be rotated continuously until hair coloring material has been applied to a desired portion of hair. If the embodiment being used contains cartridge 42, the level of hair coloring material 44 should be monitored to ensure that the hair coloring material remains in contact with bristles 14. Cartridge 42 may be biased towards bristles 14, thereby eliminating the need for hair coloring material 44 to be monitored. However, in at least one embodiment, hair coloring material 44 of cartridge 42 may be kept in contact with bristles 14 using a manually actuated device, such as, but not limited to, a threaded rod, as shown in FIG. 17, springs 90, as shown in FIG. 18, a compressible material 101, such as foam, as shown in FIG. 19, guides 46, as shown in FIG. 20, or other devices.

Brush 12 may be removed from hair coloring applicator 10 to clean hair coloring material 44 from bristles 14. Brush 12 may be placed in a solvent or other material to remove hair coloring material 44. Brush 12 may be cleaned during use, such as when a different color of hair coloring material 44 is desired to be applied to strands of hair, or after use before hair coloring applicator 10 is stored. Brush 12 also may be replaceable. In one embodiment, handle 72 may be detachable so that brush 12, housing 24, and other components may be cleaned without the possibility of damaging motor 68 contained in the handle while cleaning the brush.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A hair coloring applicator, comprising:

at least one brush having a plurality of bristles, wherein the at least one brush is rotatably coupled to a body;

wherein the body includes a housing configured to contain at least a portion of the at least one brush; and wherein the housing includes at least one opening for receiving at least one strand of hair and placing the at least one strand of hair in contact with at least one of the plurality of bristles, and the housing includes at least one device for applying a hair coloring material to the plurality of bristles; and a deflector coupled to the body so as to place at least one strand of hair in contact with at lest one of the plurality of bristles.

2. The hair coloring applicator of claim 1, wherein the at least one device for applying a hair coloring material to the plurality of bristles includes a cavity in the housing for containing a hair coloring material dispensing cartridge.

3. The hair coloring applicator of claim 2, further comprising a biasing mechanism for biasing a hair coloring material dispensing cartridge positioned in the cavity towards the at least one brush to keep a hair coloring material contained in the hair coloring material dispensing cartridge in contact with at least one of the plurality of brushes.

4. The hair coloring applicator of claim 3, wherein the biasing mechanism comprises a spring.

5. The hair coloring applicator of claim 3, wherein the biasing mechanism comprises a threaded rod.

6. The hair coloring applicator of claim 2, wherein the cavity comprises a plurality of guides for positioning the hair coloring material dispensing cartridge so that the bristles of the brush contact the hair coloring material contained in the hair coloring material dispensing cartridge.

7. The hair coloring applicator of claim 1, wherein the at least one device for applying a hair coloring material to the plurality of bristles comprises at least one orifice in the housing for receiving a hair coloring material and allowing the hair coloring material to contact at least one bristle of the at least one brush.

8. The hair coloring applicator of claim 7, further comprising a flange coupled to the housing proximate to the orifice for supporting a container capable of storing hair coloring material.

9. The hair coloring applicator of claim 1, wherein at least some of the plurality of bristles of the at least one brush are angled away from a direction of rotation of the at least one brush.

10. The hair coloring applicator of claim 9, wherein the plurality of bristles of the at least one brush are angled away from a direction of rotation of the at least one brush.

11. The hair coloring applicator of claim 9, wherein the plurality of bristles of the at least one brush are positioned at angles between about 30 degrees and about 60 degrees relative to lines tangent to a generally circular hub forming the at least one brush at points where the bristles connect to the generally circular housing.

12. The hair coloring applicator of claim 1, wherein the deflector comprises a substantially flat inside surface.

13. The hair coloring applicator of claim 1, wherein the deflector is biased toward the at least one brush.

14. The hair coloring applicator of claim 1, further comprising a motor for rotating the at least one brush.

15. The hair coloring applicator of claim 14, further comprising a gear assembly configured to couple the motor to a shaft coupled to the at least one brush.

16. The hair coloring applicator of claim 15, further comprising a power source.

17. The hair coloring applicator of claim 16, wherein the power source is at least one battery.

18. The hair coloring applicator of claim 1, wherein the at least one device for applying a hair coloring material to the plurality of bristles comprises a container releasably coupled to the housing.

19. The hair coloring applicator of claim 18, wherein the container is squeezable.

20. The hair coloring applicator of claim 18, further comprising a plunger.

21. The hair coloring applicator of claim 1, further comprising a braking mechanism for substantially preventing the at least one strand of hair from traveling backwards through the at least one opening.

22. The hair coloring applicator of claim 21, wherein the braking mechanism comprises at least one lever arm coupled to the housing.

23. The hair coloring applicator of claim 21, wherein the braking mechanism comprises at least one off-centered wheel.

24. The hair coloring applicator of claim 21, wherein the braking mechanism comprises at least two juxtaposed wheels.

25. A method for applying hair coloring material to hair, comprising:

positioning at least one strand of hair in an opening of a hair coloring applicator;

wherein the hair coloring applicator comprises:

at least one brush having a plurality of bristles, wherein the at least one brush is rotatably coupled to a body;

wherein the body includes a housing configured to contain at least a portion of the at least one brush; and wherein the housing includes at least one opening for receiving at least one strand of hair and placing the at least one strand of hair in contact with at least one of the plurality of bristles, and the housing includes at least one device for applying a hair coloring material to the plurality of bristles; and providing a deflector coupled to the body so as to place at least one strand of hair in contact with at lest one of the plurality of bristles;

contacting at least one of the plurality of bristles of the at least one brush with the hair coloring material formed from at least one color; and rotating the at least one brush containing the hair coloring material while at least one of the plurality of bristles is in contact with the at least one strand of hair.

26. The method of claim 25, further comprising applying a liquid to the at least one strand of hair.

27. The method of claim 25, wherein applying the liquid comprises applying water to the at least one strand of hair.

28. The method of claim 25, wherein rotating the at least one brush further comprises actuating a switch.

29. The method of claim 25, wherein positioning at least one strand of hair in an opening of a hair coloring applicator further comprises collecting a plurality of strands of hair.

30. The method of claim 29, further comprising positioning the hair coloring applicator proximate to a head to which the plurality of strands of hair are connected and moving the hair coloring applicator away from the head.

31. The method of claim 29, further comprising applying a force to the deflector to press the at least one strand of hair against the at least one brush to substantially prevent the at least one strand of hair from tangling and to facilitate transportation of hair coloring material from at least one of the plurality of bristles to the at least one strand of hair.

32. The method of claim 25, wherein the hair coloring material comprises a plurality of colors.

33. The method of claim 25, wherein the hair coloring material comprises hair mascara.

34. A hair coloring applicator, comprising:

at least one brush rotatably coupled to a body and formed from a plurality of bristles;

a means for contacting a hair coloring material with at least one of the plurality of bristles of the at least one brush;

a means for placing at least one strand of hair in contact with at least one of the plurality of bristles of the at least one brush, further comprising a biasing mechanism for moving a cartridge containing a hair coloring material so that the hair coloring material contacts at least one of the plurality of bristles of the at least one brush.

35. The hair coloring applicator of claim 34, wherein the biasing mechanism comprises a spring.

36. The hair coloring applicator of claim 34, wherein the biasing mechanism comprises a threaded rod.

37. A hair coloring applicator, comprising:

at least one brush rotatably coupled to a body and formed from a plurality of bristles;

a means for contacting a hair coloring material with at least one of the plurality of bristles of the at least one brush;

a means for placing at least one strand of hair in contact with at least one of the plurality of bristles of the at least one brush, wherein the means for placing at least one strand of hair in contact with at least one of the plurality of bristles of the at least one brush comprises at least one opening in a housing surrounding at least a portion of the at least one brush for receiving the at least one strand of hair; and a braking mechanism for substantially preventing the at least one strand of hair from traveling backwards through the at least one opening.

38. The hair coloring applicator of claim 37, wherein the at least one opening forms a channel with the housing and a deflector movably coupled to the housing, whereby the channel is configured to receive at least one strand of hair.

39. The hair coloring applicator of claim 38, wherein the deflector is slidably connected to the housing and is capable of applying a force to the at least one strand of hair to prevent the at least one strand of hair from tangling while the at least one brush is rotating.

40. A hair coloring device, comprising:

a housing;

an applicator mounted for rotatable movement relative to the housing;

a supply of hair coloring material at a first location relative to the housing and positioned so as to contact the applicator;

a motor having a shaft, the applicator being driven rotationally in response to rotation of the shaft; and a deflector movably coupled relative to the housing at a second location which is spaced from the first location so as to contact the applicator at the second location, the deflector defining a hair channel in the housing at the second location between an inlet into the housing and an outlet from the housing, whereby rotation of the applicator causes hair coloring material from the supply at the first location to transfer to any hair disposed in the hair channel at the second location.

41. The hair coloring device of claim 40, further comprising a bias positioned so as to urge the supply into contact with the applicator.

42. Hair coloring device of claim 40, wherein the applicator comprises a brush having bristles and wherein the bristles contact the supply of hair coloring material.

43. The hair coloring device of claim 40, wherein the applicator comprises a brush.

44. The hair coloring device of claim 43, wherein the brush includes a plurality of bristles.

45. The hair coloring device of claim 40, further comprising a braking mechanism positioned relative to the hair channel to prevent backward travel of hair into the outlet.

* * * * *

UNITED STATES PATENT AND TRADEMARK OFFICE

CERTIFICATE OF CORRECTION

PATENT NO. : 6,848,452 B2
APPLICATION NO. : 10/370262
DATED : February 1, 2005
INVENTOR(S) : Kennedy et al.

It is certified that error appears in the above-identified patent and that said Letters Patent is hereby corrected as shown below:

Title 1, FOREIGN PATENT DOCUMENTS, replace “YU” with --CN--

Figure 1, replace “41” with --39--

Figure 1, replace “39” with --41--

Figure 2, replace “41” with --39--

Figure 2, replace “39” with --41--

Figure 6, replace “41” with --39--

Figure 6 replace “39” with --41--

Figure 7, replace “74” with --75--

Figure 8, replace “74” with --75--

Figure 9, replace “74” with --75--

Figure 10, replace “74” with --75--

Figure 11, insert --39-- above the arrow to the right of 12

Figure 12, insert --41-- below the arrow to the right of FIG. 12

Column 2, line 21, make a new paragraph starting at “The brush”

Column 5, line 1, replace “strips” with --stripes--

UNITED STATES PATENT AND TRADEMARK OFFICE

CERTIFICATE OF CORRECTION

PATENT NO. : 6,848,452 B2
APPLICATION NO. : 10/370262
DATED : February 1, 2005
INVENTOR(S) : Kennedy et al.

It is certified that error appears in the above-identified patent and that said Letters Patent is hereby corrected as shown below:

Column 9, line 16, replace “lest” with --least--

Signed and Sealed this

Twentieth Day of March, 2007

JON W. DUDAS
*Director of the United States Patent and Trademark Office*